United States Patent [19]

Cooper et al.

[11] Patent Number: 4,665,387

[45] Date of Patent: May 12, 1987

[54] METHOD AND APPARATUS FOR TARGET DEACTIVATION AND REACTIVATION IN ARTICLE SURVEILLANCE SYSTEMS

[75] Inventors: Michael N. Cooper, Flushing; Peter A. Pokalsky, East Meadow, both of N.Y.

[73] Assignee: Knogo Corporation, Hicksville, N.Y.

[21] Appl. No.: 513,242

[22] Filed: Jul. 13, 1983

[51] Int. Cl.[4] ..... G08B 13/14

[52] U.S. Cl. ..... 340/572; 360/57

[58] Field of Search ..... 360/57, 66; 340/572, 340/505; 343/6.5 SS; 335/284

[56] References Cited

U.S. PATENT DOCUMENTS

| | | | |
|---|---|---|---|
| 3,665,449 | 5/1972 | Elder et al. | 340/280 |
| 3,747,086 | 7/1973 | Peterson | 340/280 |
| 3,820,103 | 6/1974 | Fearon | 340/280 |
| 3,820,104 | 6/1974 | Fearon | 340/280 |
| 4,075,618 | 2/1978 | Montean | 360/132 |
| 4,118,693 | 10/1978 | Novikoff | 340/572 |
| 4,326,198 | 4/1982 | Novikoff | 340/572 |
| 4,384,281 | 5/1983 | Cooper | 340/572 |
| 4,499,444 | 2/1985 | Heltemes | 340/572 X |

FOREIGN PATENT DOCUMENTS

| | | |
|---|---|---|
| 2732167 | 1/1978 | Fed. Rep. of Germany . |
| 3014667 | 10/1981 | Fed. Rep. of Germany . |
| 763681 | 5/1934 | France . |

*Primary Examiner*—A. J. Heinz

*Attorney, Agent, or Firm*—Fitzpatrick, Cella, Harper & Scinto

[57] ABSTRACT

Targets (14) mounted on objects (12) for detection by a magnetic type theft detection system are deactivated in a target deactivator (26,64) which has magnet assembly (40,72) made up of spaced apart magnets with alternately opposed poles extending in a plane and guide walls (36, 38, 68, 70) extending perpendicular to the plane. Targets are reactivated by a reactivator (46, 76) having a magnet (52, 80) mounted thereon and arranged to be slid along the target.

13 Claims, 12 Drawing Figures

METHOD AND APPARATUS FOR TARGET DEACTIVATION AND REACTIVATION IN ARTICLE SURVEILLANCE SYSTEMS

BACKGROUND OF THE INVENTION

1. Field of the Invention

This invention relates to magnetic type article surveillance systems wherein articles to be protected from theft have affixed thereto targets made up of elongated strips of highly permeable, easily saturable magnetic material which, when carried past an interrogation antenna, cause a detectable characteristic magnetic field disturbance to activiate an alarm. More particularly, this invention in one aspect pertains to a novel method and apparatus for deactivating said targets so that when the protected article is purchased or accounted for, it can be brought past the interrogation antenna without activiating the alarm; and the invention in another aspect pertains to a novel method and apparatus for reactivating the targets.

2. Description of the Prior Art

Magnetic type article surveillances systems for protecting articles from theft are shown and described in French Pat. No. 763,681 and in the U.S. Pat. Nos. 4,118,693, 4,326,198 and 4,384,281. As described in those patents, the targets which are affixed to the protected articles are made up of thin elogated strips of highly permeable, easily saturable magnetic material such as permalloy. Also, as described in U.S. Pat. Nos. 3,747,086, 3,820,103 and 3,820,104, the targets can be made deactivatable by providing them with deactivation elements of a low permeability, magnetically hard material, such as vicalloy which can be magnetized to provide spaced apart north and south poles which are effective to break up the magnetic continuity of the target strips. The deactivation elements are magnetized and demagnetized by subjecting them to a powerful magnetic field generated by a deactivating and reactivating machine at a checkout or authorizing station.

A problem arises when the targets are used to protect magnetically sensitive materials such as recorded magnetic tapes, which are often mounted in cassettes. When a deactivating magnetic field is applied to a target mounted on the cassette, the field will extend inside the cassette and may damage the recording on the tape.

It has been proposed to provide an electromagnetic type deactivating device comprising a plurality of windings arranged on spaced apart core poles and a switchable electric circuit to cause direct current to flow through the windings and magnetize the poles in alternate directions when an object on which a target is mounted is positioned with the target extending along the ends of the poles. Such a device, which is shown and described in German Offenlegungsschrift DE No. 30 14 667 AL, is used with targets which are provided with a deactivation element in the form of a strip of hard magnetic material laminated along the length of the target. When the hard magnetic material is subjected to the alternate magnetic fields emanating from the poles it becomes semi-permanently magnetized in different directions at different locations along its length. The magnetized deactivation element subjects the target material to a corresponding magnetic bias at successive regions along its length. When the target material is so biased it cannot function to produce magnetic responses at harmonic frequencies when subjected to an alternating magnetic interrogation field. The semi-permanently magnetized deactivation element thereafter can be demagnetized in order to reactivate the target. The magnetic fields used to magnetize the deactivation element and the fields produced by the element when it is so magnetized are confined to a region in the immediate vicinity of the material and so do not affect the magnetic characteristics of nearby magnetic materials. Consequently this deactivating arrangement may be used with targets mounted to protect magnetic tape cassettes and similar products.

Problems have been encountered in connection with target deactivation devices as described above. These problems arise because the deactivation devices are quite bulky and expensive due to the multiple magnetic cores and associated windings. Moreover, the prior deactivation devices depend on complicated electrical circuits and switches which must be arranged to energize and deenergize the electrical circuits only when the object on which the target is mounted is properly positioned on the device. Finally, the electrical circuits in these prior deactivation devices are activated for a predetermined length of time following the closure of a switch when the targeted object is placed on the device. If the object is moved laterally during this time period, the pattern of magnetization which the magnetic cores had applied to the deactivation element on the target will be affected and this may result in residual activity in the target. That is, the target may not be completely deactivated.

SUMMARY OF THE INVENTION

The present invention overcomes the above described problems of the prior art. According to the present invention, saturable magnetic strip targets having a deactivation element laminated along their length are easily and reliably deactivated without requiring the special magnetic cores, coils and special electrical circuits in the prior art.

In one aspect, the invention provides a novel target deactivation device which comprises assembly of permanent magnets lying in a flat plane with their poles arranged to form a line of spaced apart alternate north and south poles, a supporting arrangement for supporting the permanent magnet assembly and guide means arranged to allow relative movement of an object on which the target is mounted and the support means in a direction perpendicular to the flat plane while the target is maintained parallel to that plane. In a preferred embodiment the permanent magnet assembly is a magnetic strip in which barium ferrite crystals are oriented in a polymer binder and are then permanently magnetized with multiple north and south poles along its length. Also, the guide means in the preferred embodiment comprises a surface extending perpendicular to the plane of the magnetic strip and positioned so that the object on which the target strip is mounted can move only in a direction perpendicular to the strip. When the object is so guided it is retracted from the permanent magnet fields in a manner such that there is no shifting of the fields lengthwise of the strip and accordingly the magnetic pattern provided by the magnet assembly is precisely maintained and the target remains completely deactivated.

According to another aspect of the present invention there is provided a novel method of deactivating an elongated magnetic target which has a magnetically hard, low permeability deactivation element extending along its length. The novel method involves maintaining along a flat plane, a pattern of spaced apart alternate magnetic fields; and placing the target with its deactivation element along the plane of the magnetic fields so that the magnetic fields intersect the deactivation element and magnetize it in the same pattern. Thereafter the target and the plane of the magnetic fields are separated while maintaining them parallel to each other and separating them in a direction perpendicular thereto until the deactivation element is outside the influence of the magnetic fields. Preferably the object on which the target is mounted is guided for such relative movement by sliding it along a surface which extends perpendicular to the plane of the magnetic fields.

According to a further feature of this invention there is provided a novel apparatus and a novel method for reactivating a target for a magnetic theft detection system where the target is subjected to a pattern of spaced apart alternate magnetic fields from a deactivation element of magnetically hard, high permeability material laminated thereto. This novel apparatus comprises a magnet and a holder supporting the magnet. The holder is configured to be guided along an object on which the target is mounted in a direction along the length of the target, with the poles of the magnet extending along the length of the target. This guiding arrangement enables the field of the magnet to change the magnetization of the target's deactivation element and to change its pattern so that it no longer maintains the target in deactivated condition. The novel method of reactivation comprises the steps of positioning a magnet with its poles extending in a plane closely adjacent and parallel to the plane of the target so that the target's deactivation element is in the field of the permanent magnet. The magnet is then moved along the target to erase the pattern of spaced apart alternate magnetic poles from the deactivation element. In a preferred arrangement the poles of the magnet extend in the same line as the poles of the deactivation element.

BRIEF DESCRIPTION OF THE DRAWINGS

Various embodiments of the invention have been chosen for purposes of illustration and description, and are shown in the accompanying drawings forming a part of the specification wherein.

DETAILED DESCRIPTION OF THE PREFERRED EMBODIMENTS

The present invention is useful in connection with the deactivation and reactivation of magnetic strip type targets used to protect many types of merchandise; but the invention is especially advantageous when used to deactivate and reactivate such targets on magnetic tape cassettes or cartons containing such cassettes. Because of their compact size, magnetic tape cassettes can be hidden quickly and effectively and are therefore quite vulnerable to theft. Also, tape cassettes are highly prized by many segments of the population and therefore present a strong temptation to shoplifters. A magnetic type theft detection system such as shown and described for example in U.S. Pat. No. 4,384,281 has been found to be quite effective in detecting such goods when targets of highly permeable and easily saturable material, such as permalloy in the form of thin elongated strips are applied to the surface of the cassettes or cartons in which they are contained.

Figure 1:
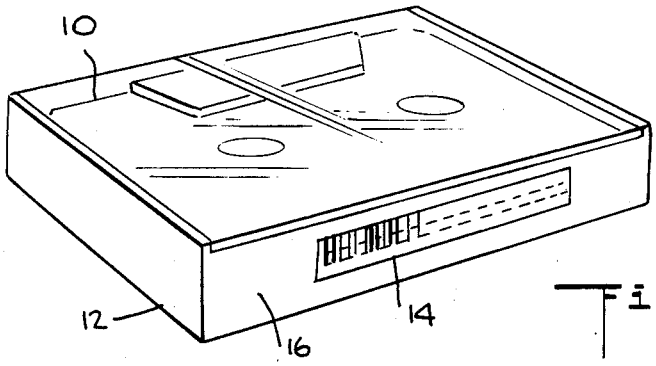
FIG. 1 is perspective view of a carton containing a magnetic tape cassette and having mounted thereon a magnetic target which is deactivated according to the present invention.

As shown in FIG. 1 a magnetic tape cassette 10 is shown contained inside a clear plastic carton 12 of rectangular shape. A bar coded price tag 14 is adhered to a bottom surface 16 of the carton. The price tag 14 is actually a laminated target assembly which is shown in detail in FIG. 2.

Figure 2:
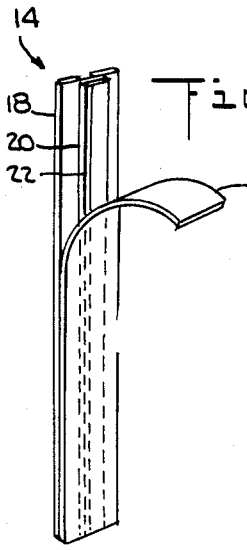
FIG. 2 is a perspective view of a target strip used on the carton of FIG. 1.

The price tag target assembly 14 shown in FIG. 2 comprises an outer paper strip 18 about one half inch (1.2 cm.) in width and four inches (10 cm.) in length. The outer surface of the strip (not shown in FIG. 2) is imprinted with price and other information and it may also contain a bar code as shown in FIG. 1. The inner surface of the strip 18 is coated with a pressure sensitive adhesive. A target element 20 extends along the length of the strip 18 in the center thereof and is adhered to the strip by means of the pressure sensitive adhesive. The target element 20 is a thin elongated strip about four inches (10.16 cm.) long, one eighth inch (3.17 mm.) wide and 0.006 inches (0.015 mm.) thick and made of a highly magnetically permeable and readily saturable material such as permalloy. Target elements one sixteenth inch (1.58 mm.) wide and 0.001 inch (0.025 mm.) thick are also used as are target elements three inches (7.62 mm) in length.

A deactivation element 22 of low permeability hard magnetic material such as vicalloy is laminated to the target element 20. Similar materials which can be used for the deactivation element 22 are sold under the trademarks CROVAC 110 and MAGNETOFLEX 35 by Vacuumschmelze GmbH of Hanau and Berlin, Federal Republic of Germany. The deactivation element 22 is capable of being magnetized in various patterns along its length corresponding to the patterns of an applied magnetic field. If the field is strong enough the magnetization imposed along the deactivation element will be retained even after the applied magnetic field is taken away.

A peel strip 24 temporarily covers the outer strip 18, the target element 20 and the deactivation element 22. The peel strip 24 is as wide or wider then the outer strip 18 and it is used to prevent the outer strip from becoming adhered to other surfaces until the target is ready to be applied to an article to be protected. At this point the peel strip 24 is pulled away, as shown in FIG. 2 to expose the pressure sensitive adhesive on the inner surface of the outer strip 18 and the outer strip is pressed against the surface of the article to be protected, with the target element 20 and the deactivation element 22 sandwiched between the outer strip and the surface of the article.

As long as the deactivation element 22 is not magnetized, the target element 20 will respond to the alternating magnetic fields produced in the interrogation zone of a magnetic type theft detection system. In order to deactivate the target so that the article it has protected (e.g. the tape cassette 10) can be taken through the interrogation zone without producing a response, the deactivation element 22 must be magnetized according to a predetermined pattern. This magnetization is carried out by means of a target deactivator 26.

Figure 3:
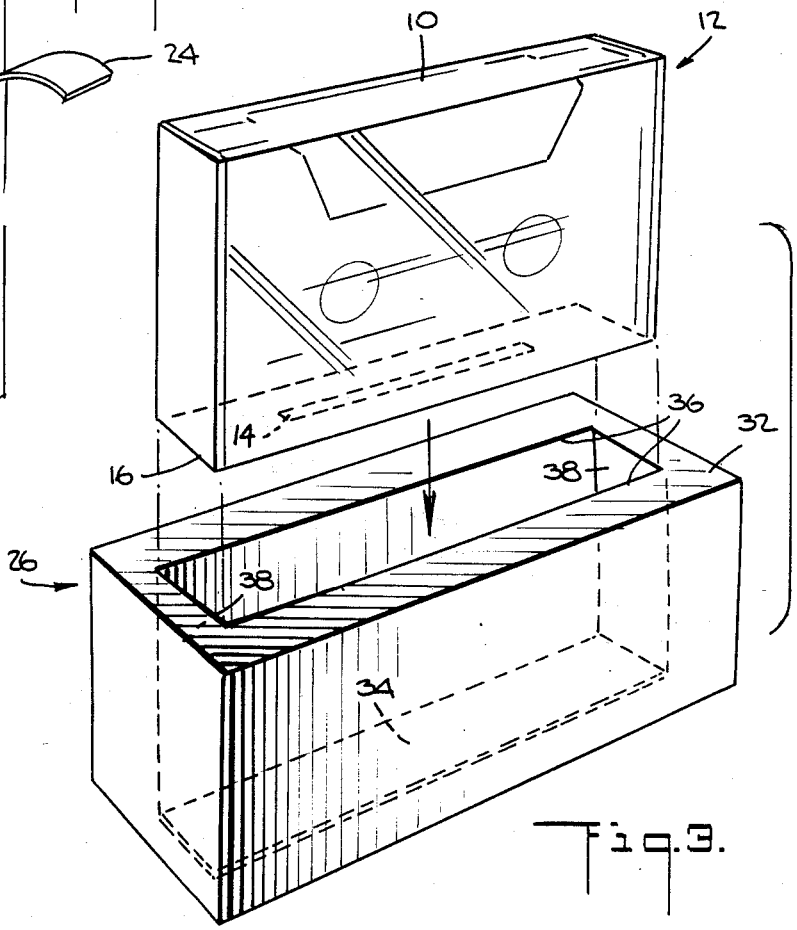
FIG. 3 is a perspective view of a target deactivator according to the present invention with the carton of FIG. 1 being inserted thereinto for deactivation of its target.

The target deactivator 26 is made up of a rectangular housing 28 of plastic or other non-magnetic material and formed with a rectangular cavity 30 which opens onto an upper surface 32. The cavity 30 has a flat bottom surface 34 and flat upstanding side walls 36 and end walls 38. The side and end walls 36 and 38 are perpendicular to the bottom surface 34 and they are arranged to closely accommodate the tape cassette carton 12 so that it can be inserted into the cavity 30 only as indicated in FIG. 3. As can be seen, when the carton 12 is inserted into the cavity 30 the price tag target assembly 14 on the bottom surface 16 of the carton comes into contact with the flat bottom surface 34 of the cavity.

Figure 4:
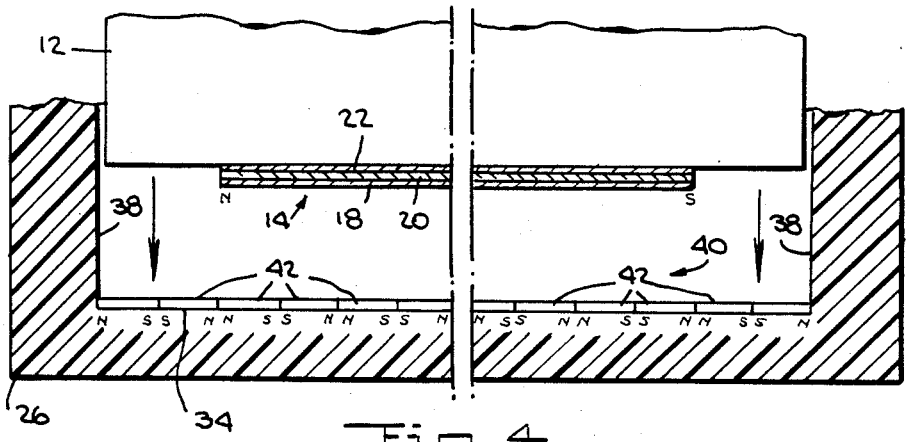
FIG. 4 is a fragmentary elevation section view showing the carton of FIG. 1 with its target being partially inserted into the deactivator of FIG. 3.

Turning now to FIG. 4 it will be seen that there is provided a magnet assembly 40 along the bottom surface 34 of the cavity 30. The magnet assembly comprises a plurality of magnets 42 positioned with their poles lying along the plane of the surface 16 and arranged in opposite alternate directions to form a sequence of spaced apart alternate north and south poles.

Preferably the magnets 42 are formed in a magnetic strip which comprises barium ferrite crystals in a polymer binder. The barrium ferrite magnet material is permanently magnetized to form the spaced apart alternate north and south poles. Such magnetic strips are known in the prior art and are sold under the brand name PLASTIFORM® Magnetic Strip, MGO Magnetic Strip by the Industrial Electrical Products Division of the Minnesota Mining and Manufacturing Company, St. Paul, Minn. Preferably, the alternate poles are spaced apart from each other by about 0.09 inches (2.29 mm.).

Figure 5:
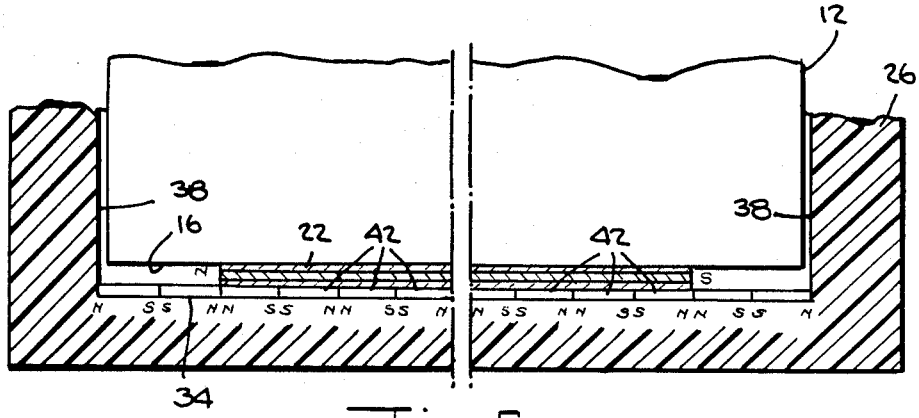
FIG. 5 is a view similar to FIG. 4 but showing the carton fully inserted into the deactivator.

As can be seen in FIGS. 4 and 5, the walls 36 and 38, which extend perpendicular to the bottom surface 34 and the plane of the magnets 42, guide the carton 12 as it is inserted into the cavity 30 so that the bottom wall 16 of the carton, on which the price tag target assembly 14 is mounted will be maintained parallel to the plane of the magnets 42 and will move only in a direction perpendicular to that plane both during insertion of the carton into the cavity and during retraction of the carton out of the cavity.

When the carton 12 is fully inserted into the cavity 12 so that the price tag target assembly 14 comes to rest on the magnets 42, the deactivation element 22 becomes subjected to the magnetic fields which extend between the alternate magnetic poles. These fields are sufficiently strong in the region of the deactivation element 22 to impose a semi-permanent magnetization on the element according to the pattern of the magnets. That is, when the element 22 is no longer in the magnetic field it will retain, for an indefinite time, the pattern of magnetization of the magnets 42; although it can have its patterns of magnetization altered at a later time by subjecting it to other magnetic fields. Thus the deactivation element 22 will act as a series of magnets with spaced apart alternate north and south poles extending along the length of the element. The magnetic pattern thus imposed on the deactivation element will cause the element to magnetize different regions of the target element 20 according to the same pattern. As a result, the target element is rendered incapable of responding to the alternate magnetic interrogation field of a magnetic theft detection system to produce detectable responses. It will be noted, however, that because the magnets 42 are arranged with their poles lying in a common plane, the magnetic fields extending between the poles are confined essentially to a region very close to that plane; and while those fields are very strong in the region of the deactivation element 22 they do not extend into the cassette 10 itself with sufficient strength to affect the magnetic tape of the cassette.

Figure 6:
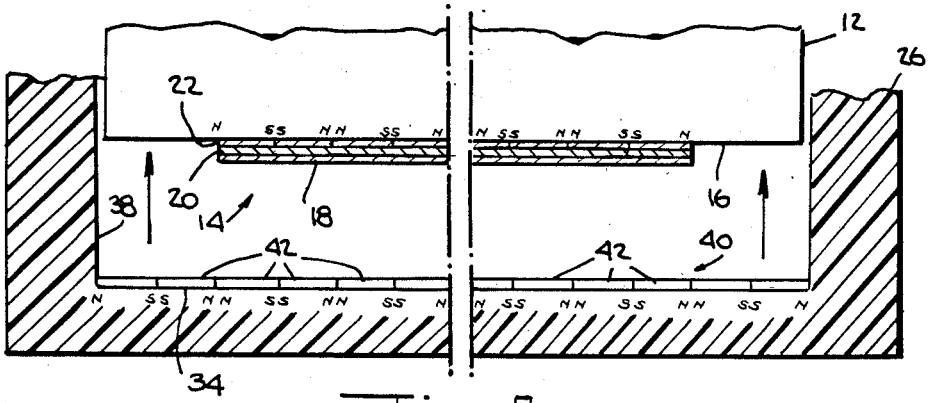
FIG. 6 is a view similar to FIG. 5 but showing the carton being withdrawn from the deactivator.

After the carton 12 has been fully inserted into the cavity 30 of the target deactivation device 26, as shown in FIG. 5, the carton is withdrawn, as shown in FIG. 6. During this withdrawal, the carton 12 is moved in a direction perpendicular to the plane of the magnets 42 by virtue of the guiding action of the cavity walls 36 and 38 on the corresponding carton walls; and the plane of the price tag target assembly is maintained parallel to the plane of the magnets. As a result the direction of the magnetic field imposed on each portion of the deactivation element 22 remains unchanged during withdrawal of the carton 12 and the pattern of magnetization of the deactivation element 22 is preserved. This is important because any lateral movement of the deactivation element 22 while it is still subject to the magnetic fields produced by the magnets 42 would in effect smear the magnetic field pattern in the element and render it incapable of deactivating the target element 20.

After the carton has been removed from the target deactivator 26 the magnetic field pattern imposed on the semi-permanently magnetized deactivation element 22 of the price tag target assembly 14 will maintain the target element 20 deactivated for an indefinite period of time.

Figure 7:
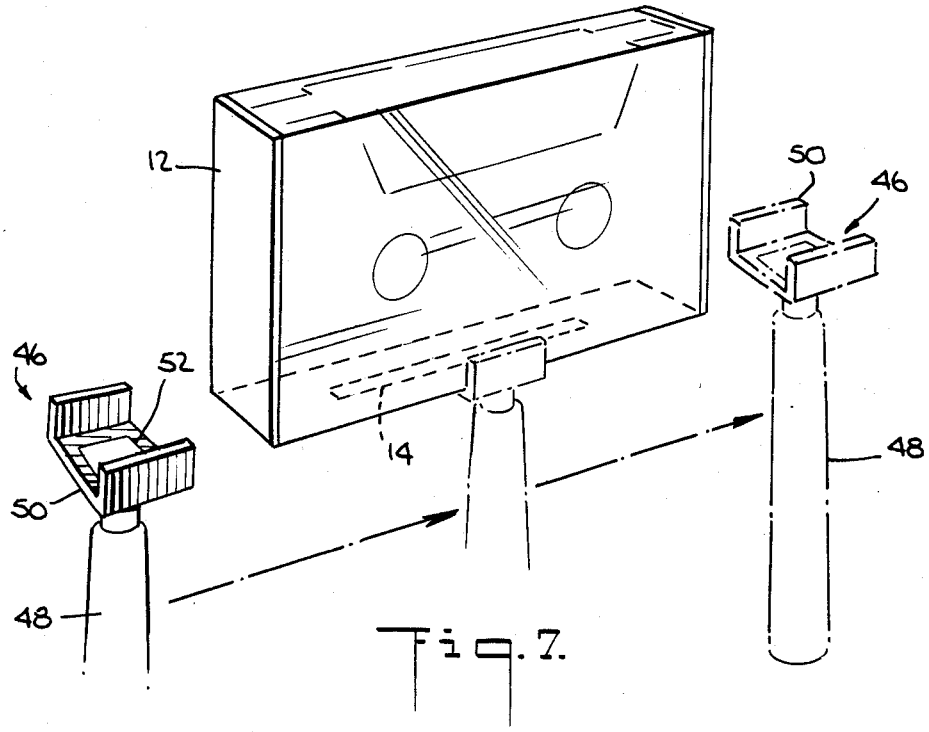
FIG. 7 is a perspective view showing the use of a target reactivator according to the present invention used to reactivate a magnetic target on the carton of FIG. 1.

For certain applications, for example in the case of a lending library, it may be desired to reactivate the target element 20. This is done by moving a magnet laterally along the element thereby to erase the magnetic pattern imposed by the target deactivator 26. For this purpose there is provided, as shown in FIG. 7, a reactivator 46. The reactivator comprises a handle 48 on the end of which is mounted a U-shaped channel guide 50 which is dimensioned to fit closely around the bottom wall 16 of the carton 12.

A multipole magnet assembly 52 is positioned on the base of the guide 50 with its poles extending between the ends of the channel. This multipole magnet assembly consists of a plurality of spaced apart magnets with alternate magnetic poles in the same arrangement as the magnets 42 of the deactivator 26. This arrangement of magnets provides a strong magnetic field for changing the magnetization of the deactivator element 22 and at the same time the multiple separated and alternately oriented poles maintain the magnetic field close to the plane of the magnets so that there is no interference with the contents of the carton or container on which the target assembly is mounted. Thus the possibility of erasing a magnetic tape in a tape cassette by the reactivator magnet is avoided.

Figure 8:
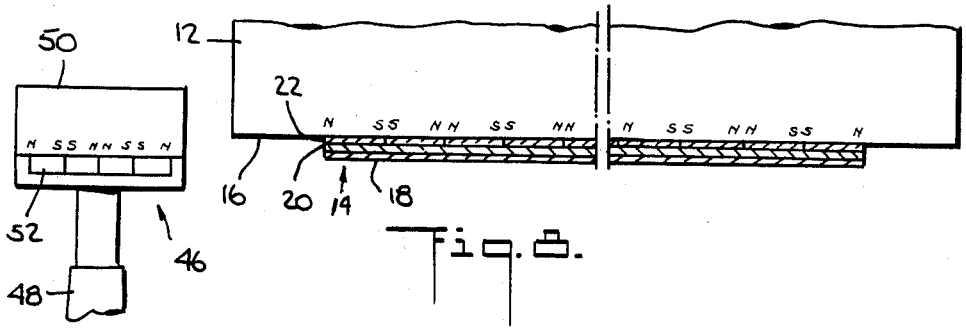
FIG. 8 is a fragmentary elevational view, partly in section, showing the carton and target of FIG. 1 and the reactivator of FIG. 7 at the beginning of a reactivation operation.
Figure 9:
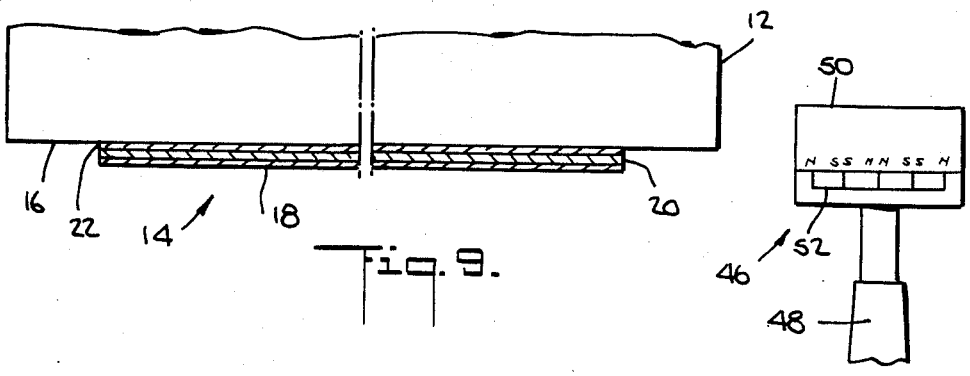
FIG. 9 is a view similar to FIG. 8 but showing the target reactivator at the end of the reactivation operation.

The reactivator 46 is used by fitting its channel guide 50 over the bottom of the carton 12 near one end, as shown in FIGS. 7 and 8; and then the reactivator is slid along the bottom of the carton so that the magnet assembly 52 passes along the length of the deactivation element 22 of the price tag target assembly 14 as shown in FIG. 7. This movement of the magnet assembly 52 effectively erases the pattern of spaced apart alternate magnetic poles on the deactivation element 22 and forms it into a single magnet as can be seen in FIG. 9. Once this pattern of discrete alternate magnetic poles is removed, the target element 20 will thereafter respond to the alternate magnetic interrogation field of a magnetic theft detection system to produce detectable harmonic fields.

Figure 10:
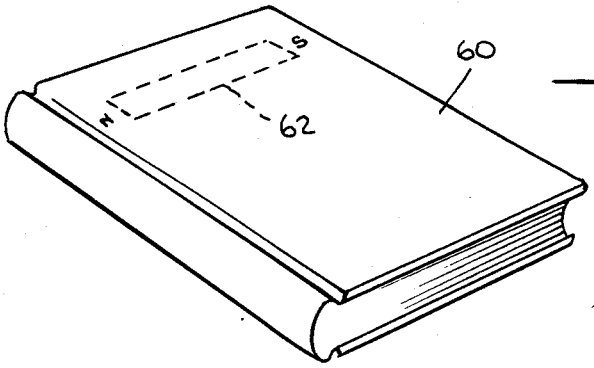
FIG. 10 is a perspective view of a book and showing in dashed outline a magnetic type theft detection target hidden in the book.
Figure 12:
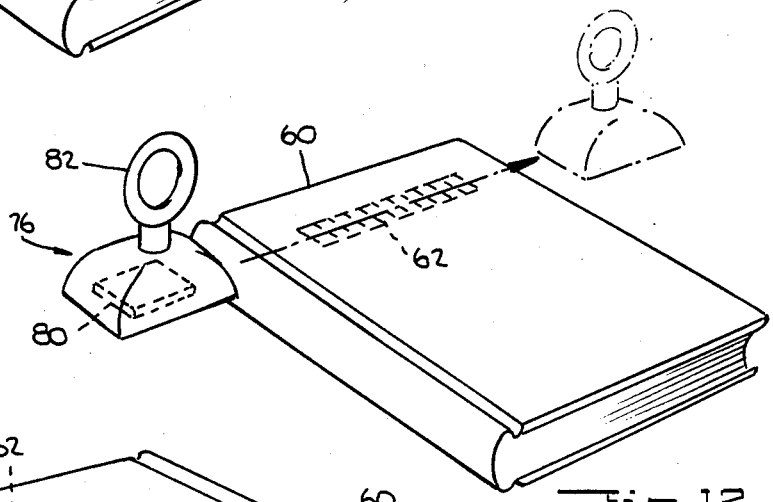
FIG. 12 is a perspective view of an alternate form of target reactivator being used to reactivate the target on the book of FIG. 10.
Figure 11:
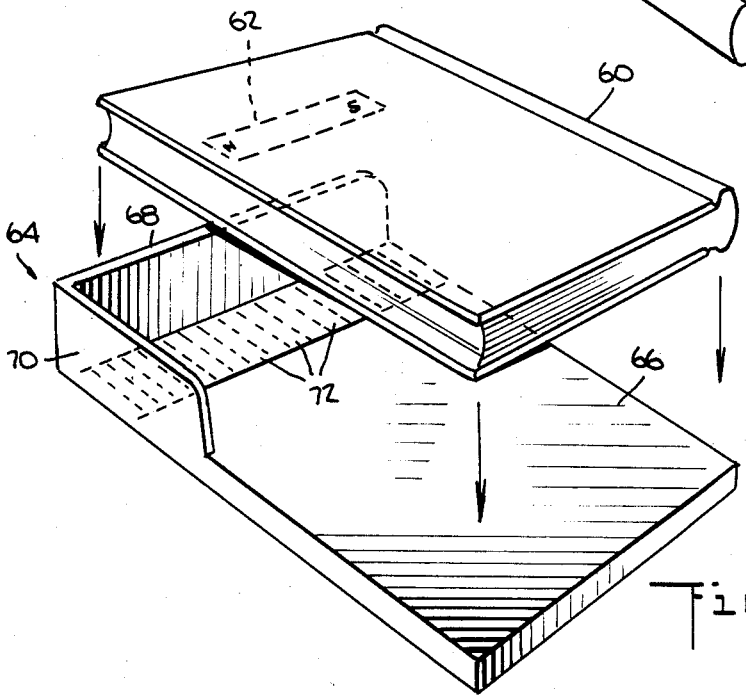
FIG. 11 is a perspective view of an alternate form of a target deactivator according to the invention as used with the book of FIG. 10.

FIGS. 10–12 show an alternate magnetic target deactivator reactivator arrangement suitable for use with targets used to protect books. As shown in FIG. 10 a book 60 is provided inside one of its covers with a target 62 of a construction similar to that used in the above described magnetic tape cassette carton. That is, the target 62 comprises an elongated target strip of permalloy or equivalent material and an elongated deactivation element of a hard magnetic material laminated to the target strip.

In order to deactivate the target 62 there is provided a book target deactivator 64 as shown in FIG. 11. This book target deactivator comprises a flat rectangular base 66 having vertical walls 68 and 70 extending vertically upward from two adjacent edges. A series of permanent magnets 72 of the same configuration and arrangement as the permanent magnets 42 of the preceding embodiment are arranged on the base 66 along the vertical wall 68. The target 62 is positioned on the book cover at a location such that when the book lies on the base 66 with two adjacent edges of its cover abutting the walls 68 and 70 the target 62 will overlie and extend along the magnets 72.

To deactivate the target 62, the book 60 is placed flat on the base 66 with its edges abutting the walls 66 and 70 and its target 62 extending along and overlying the magnets 72 so that the spaced apart alternately directed magnetic fields of the magnets extend through and magnetize the deactivation element on the target according to the same magnetic pattern. The book is then raised up off the base 66 with its edges sliding up along the vertical walls 66 and 70 and the book cover maintained parallel with the base 66 until the deactivation element of the target 62 is outside the influence of the magnets 72. During the upward movement of the book the walls 66 and 70 prevent any relative lateral movement between the deactivation element on the target and the magnets 72. Thus the pattern of magnetization imposed on the deactivation element is not changed; it merely becomes weaker. As a result, the target's deactivation element becomes semi-permanently magnetized according to the pattern of the magnets 72 to deactivate the target 62.

It will be appreciated that the vertical walls 68 and 70 provide guide surfaces which extend perpendicular to the plane of the magnets 72 to ensure that the target 62 will be maintained parallel to the plane of the magnets and will be moved in a direction perpendicular to that plane as the target is separated from the magnets. This ensures that there will be no smearing or erasing of the magnetic field pattern imposed on the target 62 as the book 60 is removed from the deactivator.

FIG. 12 shows a reactivator 76 for use in reactivating the target 62. The reactivator 76 comprises a housing 78 with a flat bottom surface in which a magnet assembly 80 is embedded. This magnet assembly preferably is made up of a plurality of magnets with spaced apart alternate poles as in the magnet assembly 52 of the preceding embodiment. A handle 82 is mounted on top of the housing. To reactivate the book target 62 the reactivator 76 is placed on the cover of the book over the target and is slid along the length of the target. As in the case of the preceding embodiment, the movement of the magnet 80 will cause the magnetic pattern on the deactivator element of the target to be erased and the target will thereupon become responsive to the interragation magnetic fields of a theft detection system to produce harmonic responses.

While the target deactivator arrangements of this invention have been described in conjunction with target assemblies in which the deactivator element extends the full length of the target element, it will be understood that the invention may also be used to deactivate target assemblies which use deactivation elements in the form of separated slugs of hard magnetic material spaced apart along the length of the target strip. These slugs are about one half inch (1.27 cm.) in length and they are spaced apart by one half inch (1.27 cm.). When the target is deactivated, the spaced apart magnetic poles of the deactivator impose in each slug a pattern of magnetization corresponding to multiple spaced apart alternate magnetic poles; and this in turn causes different lengths of the target to become deactivated. Although the intermediate portions of the target strip, where no slug is present, do not become subjected to this pattern of multiple alternate magnetic poles those intermediate portions are too short to function effectively as a target in a theft detection system.

It should be understood that the reactivators described herein will not function to reactivate a slug type target assembly which has been deactivated as above described and instead the target assembly must be reactivated by subjecting the assembly to a magnetic field pattern which removes all magnetization from the slugs.

It will be appreciated from the foregoing that present invention provides convenient and economical target deactivator and, for certain target assemblies, reactivation, with a high degree of reliability.

We claim:

1. A target deactivator for deactivating a target used in a magnetic type theft detection system, said target comprising a thin elongated strip of magnetically soft, high permeability and easily saturable magnetic material and having laminated thereto a deactivation element of magnetically hard, low permeability magnetic material, said target deactivator comprising a permanent magnet assembly made up of a plurality of permanent magnets lying in a flat plane with their poles arranged to form a line of spaced apart alternate north and south poles, support means for supporting said permanent magnet assembly and guide means for constraining relative movement between an object on which said target is mounted and said support means along a direction perpendicular to said flat plane while said target is maintained parallel to said plane.

2. A target deactivator according to claim 1 wherein said support means is formed as the bottom surface of a cavity in a housing and said guide means is formed as the side walls of said cavity, said side walls extending perpendicular to said bottom surface.

3. A target deactivator according to claim 1 wherein said support means comprises a flat base and wherein said guide means comprises at least one wall extending perpendicularly up from said base.

4. A target deactivator according to claim 1 wherein said permanent magnet assembly comprises magnetic crystals oriented in a polymer binder and permanently magnetized with spaced apart alternate north and south magnetic poles.

5. A method of deactivating a target used in a magnetic type theft detection system, said target comprising a thin elongated strip of magnetically soft, high permeability and easily saturable material and having laminated thereto a deactivation element of magnetically hard, low permeability magnetic material, said method comprising the steps of maintaining along a flat plane, a pattern of spaced apart alternate magnetic fields and, while maintaining said target and plane parallel to each other, moving one toward the other until said magnetic fields cause the formation of corresponding magnetic poles in said deactivation element and thereafter separating said deactivation element and said plane along a direction perpendicular thereto until the deactivation element is outside the influence of the magnetic fields.

6. A method of deactivating a target according to claim 5 wherein said target is moved toward said plane and thereafter is moved away from said plane.

7. A method of deactivating a target according to claim 5 wherein said target is mounted on an object and said object is moved toward and away from said plane.

8. A method of deactivating a target according to claim 5 wherein said target is mounted on one surface of a rectangular object and said spaced apart magnetic fields are maintained by permanent magnets arranged on a flat base adjacent a wall which extends perpendicular to said base and wherein said rectangular object is positioned against said wall with said target facing and extending along said magnets and is moved along said wall to move said target toward and away from said magnets.

9. A target reactivator for reactivating elongated magnetic targets used in theft detection systems and which have been deactivated by a pattern of spaced apart alternate magnetic fields emanating from a deactivation element of magnetically hard low permeability material lying adjacent and extending continuously along the target and affixed with the target to an object being protected by the target, said reactivator comprising a magnet and a holder supporting said magnet, said holder having at least one guide projection which engages an edge of the object and permits the holder to be guided along said object in a direction along the length of the target with the poles of the magnet extending along the length of the target whereby the deactivation element becomes subjected to the field of said magnet and said pattern of spaced apart magnetic fields becomes erased by movement of said holder as it is guided along said object.

10. A target reactivator according to claim 9 wherein said magnet is a magnet assembly having a plurality of spaced apart alternate magnetic poles extending in a plane.

11. A target reactivator according to claim 9 wherein said holder comprises a U-shaped member which fits over the bottom surface of a rectangular carton and slides along the bottom surface of the carton and wherein said magnet is mounted in the base of said member to slide along a target mounted on said bottom surface of said carton.

12. A method of reactivating an elongated magnetic target used in a theft detection system and which has been deactivated by a pattern of spaced apart alternate magnetic fields emanating from a deactivation element of magnetically hard low permeability material lying adjacent the target and affixed with the target to an object being protected by the target, said method comprising the steps of supporting a magnet in a holder having a guide projection, engaging said projection with an edge of the object parallel to the target, bringing the magnet into confronting relationship with the deactivation element and, while said projection is engaged with said edge of the object, moving said holder along said edge of the object to move said magnet along the target to erase the pattern of spaced apart alternate magnetic fields from said deactivation element.

13. A method of reactivating an elongated magnetic target according to claim 12 wherein the poles of said magnet are maintained in a direction lengthwise of said target.

* * * * *